United States Patent [19]

Chen

[11] Patent Number: 5,052,150

[45] Date of Patent: Oct. 1, 1991

[54] STRUCTURE OF VENETIAN BLIND

[76] Inventor: Chih-Tsung Chen, No. 20, Ming Chuan Road, Lu Kang Chen, Changhua Hsien, Taiwan

[21] Appl. No.: 584,224

[22] Filed: Sep. 18, 1990

[51] Int. Cl.[5] ..... E06B 7/08

[52] U.S. Cl. ..... 49/84; 98/121.2

[58] Field of Search ..... 49/74, 84; 98/121.2

[56] References Cited

U.S. PATENT DOCUMENTS

| | | | |
|---|---|---|---|
| 1,701,695 | 2/1928 | Paine | 49/74 |
| 2,137,426 | 11/1938 | Thompson | 98/121.2 X |
| 2,651,085 | 9/1953 | Kopp | 49/84 X |
| 3,049,203 | 8/1962 | Bayer | 49/84 |
| 3,680,470 | 8/1972 | Neece | 98/121.2 X |
| 4,084,491 | 4/1978 | Spotts et al. | 98/121.2 |
| 4,184,288 | 1/1980 | Magill et al. | 49/84 X |
| 4,621,570 | 11/1986 | Bolton et al. | 98/121.2 X |
| 4,967,511 | 11/1990 | Werginz et al. | 49/74 X |

*Primary Examiner*—Rodney M. Lindsey
*Assistant Examiner*—Jerry Redman
*Attorney, Agent, or Firm*—Browdy and Neimark

[57] ABSTRACT

The present invention is concerned with an innovative design of venetian blind providing the functions of sun screening, light regulating, the prevention of burglary and beautiful appearance; in particular, the one which is easy to be assembled by consumers themselves. It is to unite and fix a lot of supporting seats in equal spacing on a fixed guide rail and then connect serially with a regulating shaft which is combined with a regulating wheel; the supporting seats are combined with a slat respectively and the top end of the slat is restricted and positioned by two fixing plates which allows the slat to turn. The regulating shaft is driven to rotate by the regulating wheel and then the supporting seats would drive in turn the slats to turn to adjust the angle of the slats of the venetian blind.

1 Claim, 5 Drawing Sheets

STRUCTURE OF VENETIAN BLIND

BACKGROUND OF THE INVENTION

An improvement of the structure of venetian blind to fix a fixing rail and two fixing plates on the bottom side and the top side of the frame of the window and then combine a plurality of supporting seats equally spaced inside the fixing rail and connect the supporting seats in series with a regulating shaft which is combined with a regulating wheel; the supporting seats and the lower end of the slat are combined together with the top end of the slat to be restricted and positioned by two fixing plates. The assembly is driven by the regulating wheel to adjust the angle of the slats and provide consumers with the convenience of easy assembly.

PRIOR ART AND SHORTCOMING

The size of conventional venetian blind is fixed in the process of production, consumers have to adapt to existing size of the venetian blind, once the size of the venetian blind is unfit for use, it requires to be replaced with another one. This presents the following shortcomings: the installing is inconvenient, the fitness of accurate size is always difficult, and the unfit venetian blind must be revised and installed by skilled personnel. Under the circumstance of increasingly shortage of labor, it causes perplexity of the consumers.

TECHNOLOGICAL MEANS OF RESOLUTION

An improvement of the shortcomings in the structure of conventional venetian blind to fix a fixing rail on the lower side of the frame of the window with a lot of supporting seats to be positioned and fixed on it in equal spacing. There is a worm gear on the supporting seat to mesh with the gear at the lower end of a shaft lever and then penetrate the worm gear with a regulating shaft to connect the supporting seats in series; the regulating shaft combines with a regulating wheel and the shaft lever of the supporting seat combines with a slat. The slat is constituted by a slat body and two adapters to be set on either end, and there are two fixing plates to be fixed on the upper frame of the window allowing the insertion and positioning of the top ends of the slats for convenience of consumers to make appropriate arrangement of the venetian blind in accordance with the height and width of the window for easy assembling.

SUMMARY OF THE INVENTION

An object of this invention is to provide an improvement of the structure of venetian blind to revise the device in accordance with the size of the window for the convenience of being easy to assemble by the consumer himself to attain the best efficiency of construction and have the requirement of the window to be met by the adjustment of the slats of the venetian blind.

A further object of this invention is to provide an easy assembling structure of the venetian blind for which the work of assembling doesn't require to be performed by skilled personnel; the size is able to be revised by the consumer himself in accordance with practical requirement, and the installing simple, easy and fast.

DESCRIPTION OF THE PREFERRED EMBODIMENTS

EMBODIMENT 1

Figure 1:
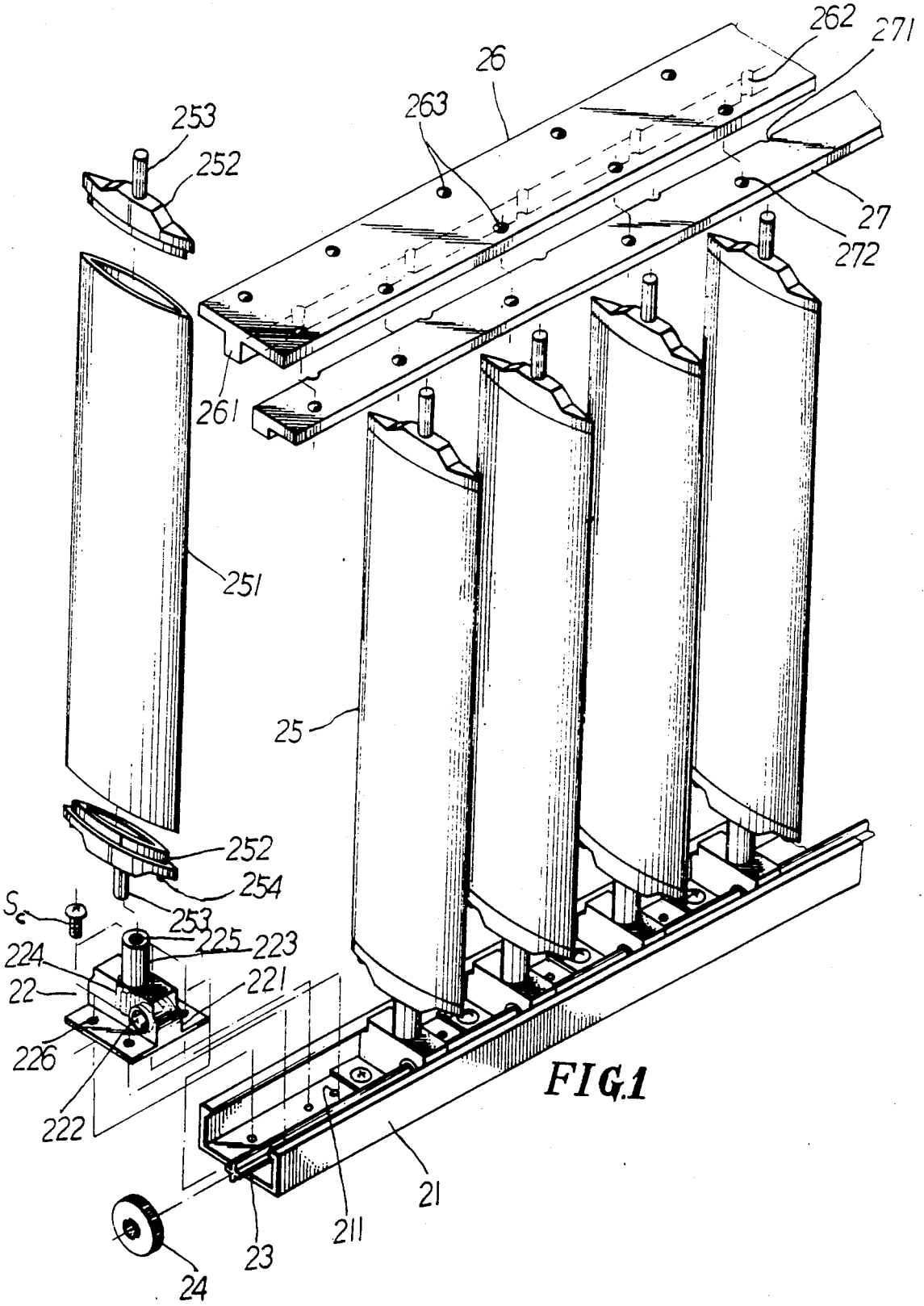
FIG. 1 is the solid decomposed view of the embodiment 1of the present invention.

Referring now to FIG. 1, the venetian blind 2 includes a fixing rail 21 in long straight trough shape (U type) with a lot of penetrating holds 211 in pairs and equal spacing, a lot of supporting seats 22 with a shaft lever receiver 223 penetrating a worm gear 222 to be pivoted on the seat body 221, in the meantime the worm gear 222 meshes with the gear 224 which is mounted on the lower end of the shaft lever receiver 223. There is an axial hole 225 of the shaft lever receiver 223, and there are flanges with penetrating holes 226 in pairs at the two sides of the seat body 221 which has the penetrating holes 226 corresponding with the penetrating holes 211 of the fixing rail 21 to have the seat body 221 to be fastened and fixed on the fixing rail 21 with screw Sc and allow the supporting seats 22 to be arranged in equal spacing so that the rotation of the worm 222 would bring the shaft lever receiver 223 to rotate together.

There is a regulating shaft 23 penetrating the supporting seats 222 in series and bringing them to move synchronously, and a regulating wheel 24 is set on one end of the regulating shaft 23 which directs the rotation of the regulating shaft 23.

There are slats 25 in same number of the supporting seats 22 which is constituted by the slat body 251 and the adapters 252 to be set on either end of the slat with the adapters 252 being encased into or set outside the slat body 251; there is a shaft lever 253 in the center of the adapter 252, or a pair of posts 254 in parallel are increased on the two sides of the shaft lever 253 to facilitate the slat 25 to be inserted into the axial hole 225 of the above supporting seat 22 with the shaft lever 253 at the lower end of the adapter.

There is a strip shape fixing plate 26 and an axial flange 261 with positioning trough 262 on the lateral side to be spaced equally corresponding with the axial hole 225 of the supporting seat 22 allowing the setting and positioning of the shaft lever 253 at the top end of the slat 25 along with a lot of penetrating holes 263 at both sides of the flange.

A right-angled fixing plate 27 with a lot of troughs 271 on the lateral side corresponding with the positioning troughs 262 to form a full circular positioning hole along with a lot of penetrating holes 272 corresponding with the above penetrating holes 263 to facilitate the fastening of the two fixing plates together with screws.

Figure 2:
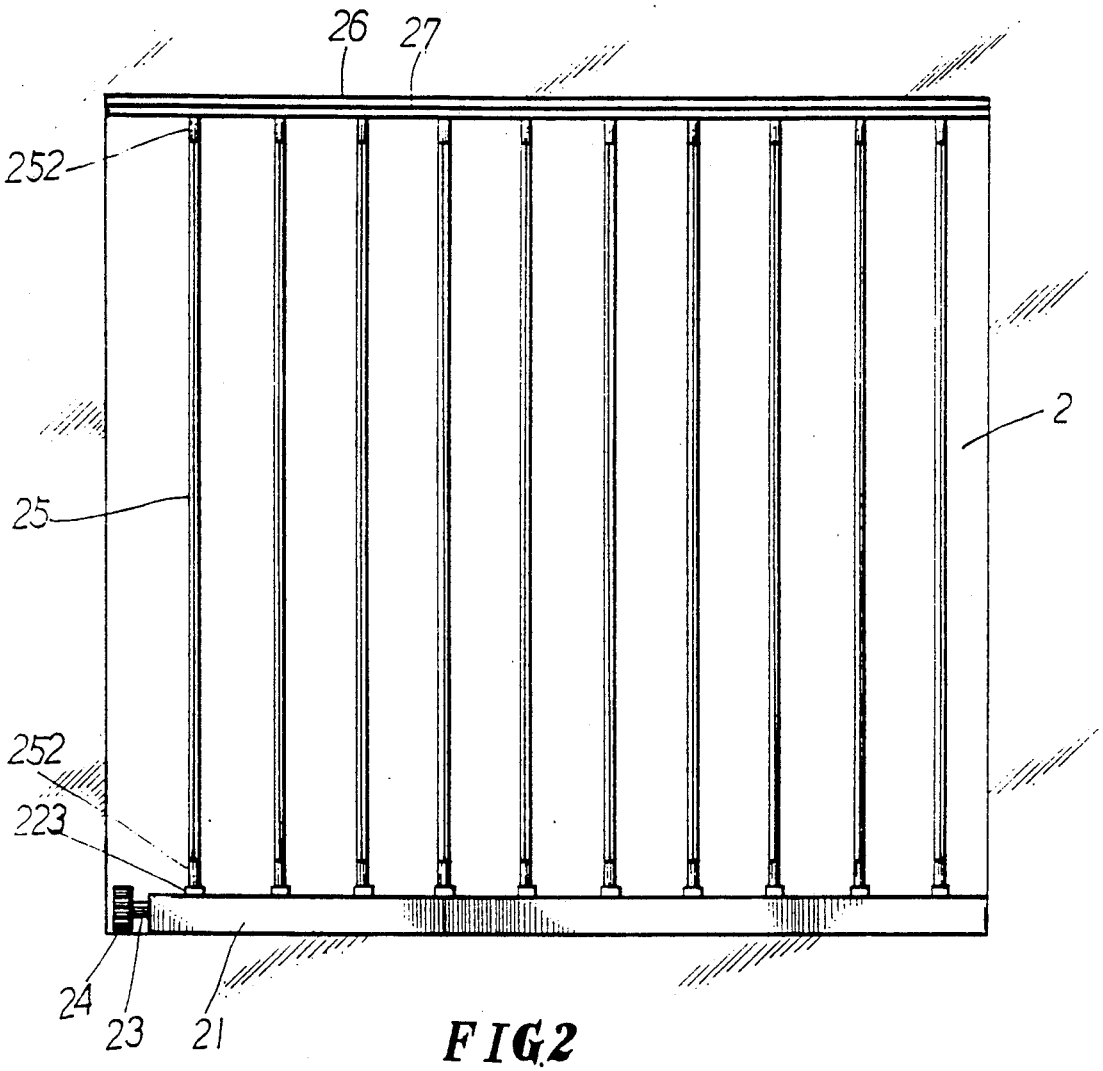
FIG. 2 is the lateral front view of the combination of embodiment 1 of the present invention.

The venetian blind 2 to be composed by the above components is able to be adjusted in accordance with the size of the window by revising the length of the fixing plates 26, 27, and then fix first the fixing plate 26 on the top side of the frame of the window with the flange 261 facing downward and the positioning trough 262 facing inward, next fix the supporting seats 22 in equal spacing on the rail 21, and then penetrate the regulating shafts 23 through the worm gears 222 of the supporting seats 22 to combine and fix the regulating wheel 24 at the end, insert further the shaft levers of the lower adapters 252 of the slats 25 into the axle holes 225 of the shaft lever 223 of the supporting seats 22 and move the combination to the bottom of the frame of the window, finally insert the shaft levers 253 on the top ends of the slats 25 into the positioning trough 262 along with the encasing and fixing of the fixing plates 27 to fix the top ends of the slats 25, in the meantime, fix the fixing rail 21 on the bottom of the frame of the window to complete the assembly of the venetian blind (referring to FIG. 2).

Figure 3:
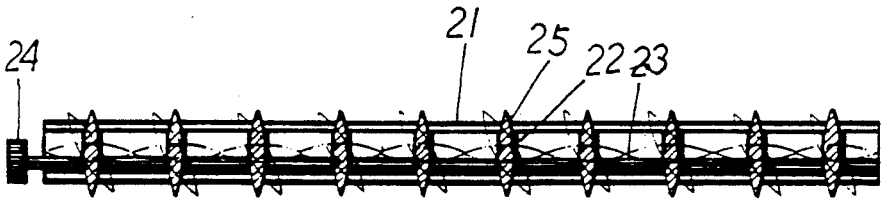
FIG. 3 is the schematic drawing of the horizontally sectional view of the embodiment 1 of the present invention.

After completing the assembly of the venetian blind 2, it is able to drive the regulating shaft 23 to turn by the turning obversely and reversely of the regulating wheel 24 and then bring the worm gear 222 and gear 224 along with the shaft lever receiver 223 to turn resulting in the turning and shifting leftward and rightward of the slats 25 to attain the adjustment of the angle of the slats 25 (referring to FIG. 3).

EMBODIMENT 2

Figure 4:
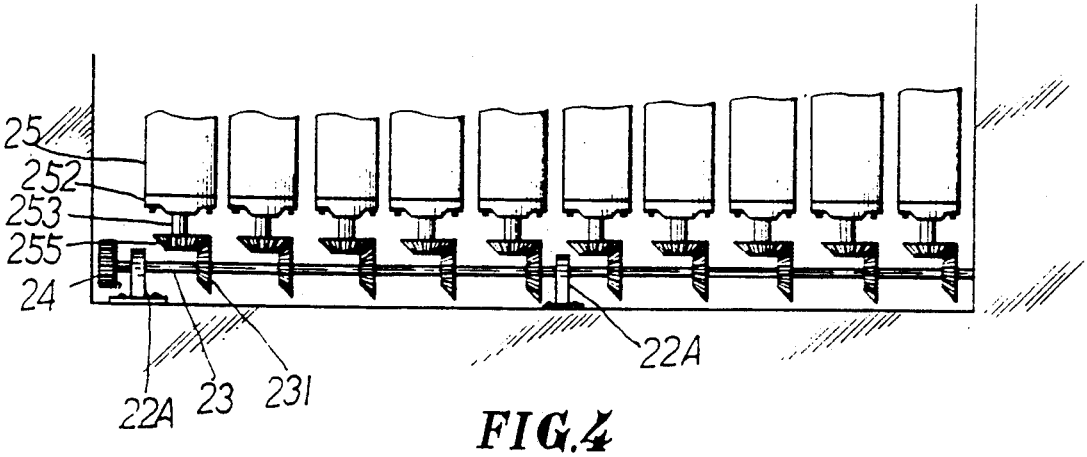
FIG. 4 is the lateral front view of embodiment 2 of the present invention.

Referring to FIG. 4, the regulating shafts 23 of the above venetian blind 2 are supported and positioned by a lot of supporting seats 22A and combined a lot of bevel gears 231 on the shafts in equal spacing with regulating wheels 24 at the end, and then the bevel gears 231 mesh with the bevel gears 255 to be combined with the shaft levers 253 which connect the slats 25 and the adapters 252; the rotation of the regulating wheel 24 bring the regulating shaft 23 to turn via the change of the direction of the two bevel 231, 255 to drive slats 25 to turn for the purpose of the adjustment of the angle of the slats.

EMBODIMENT 3

Figure 5:
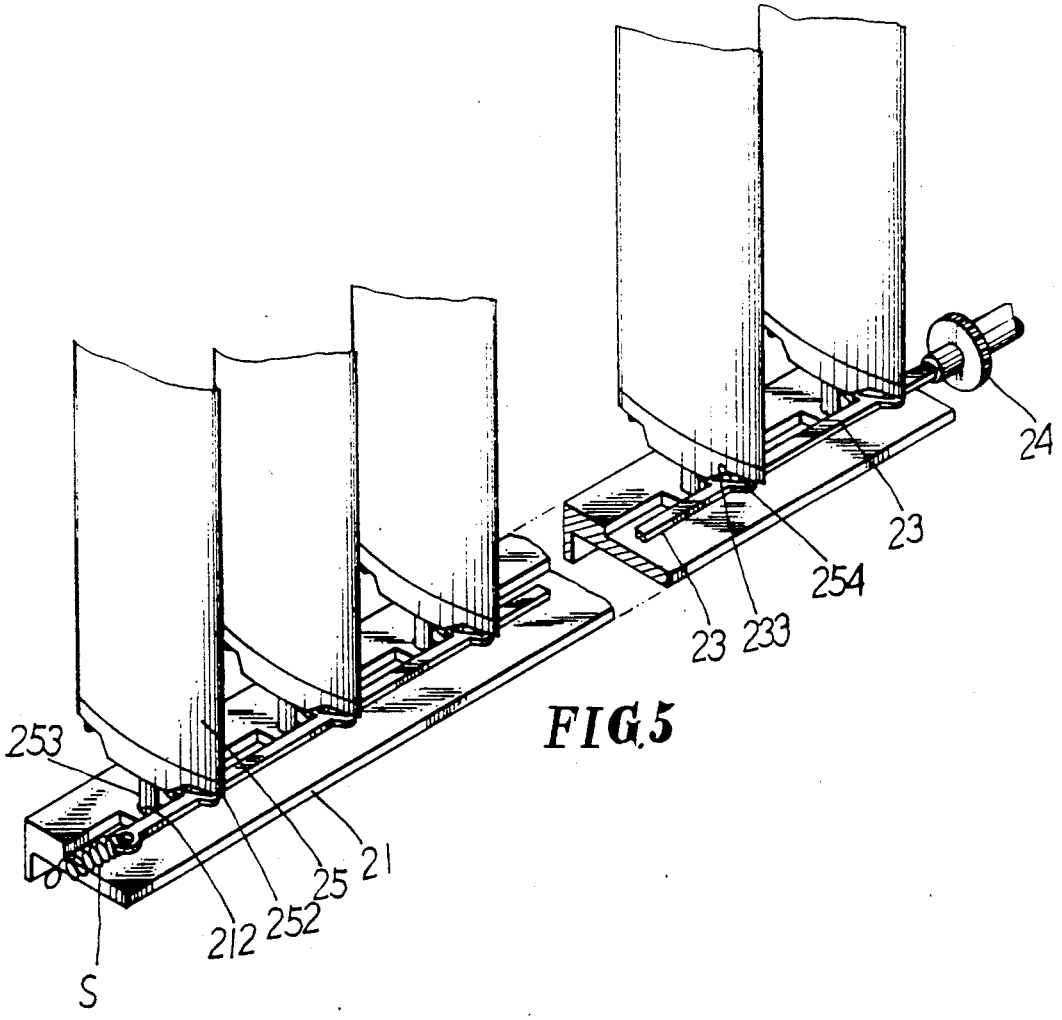
FIG. 5 is the solid view of embodiment 3 of the present invention.

As shown in FIG. 5, the strip shape fixing rail 21 has a lot of positioning troughs 212 in equal spacing allowing the inserting and positioning of the shaft level 253 of the adapter 252, the one end of the regulating shaft 23 is connected with spring component S and the other end combines with a regulating wheel 24 which is fastened into the tap hole with a screw to facilitate the turning and regulating of the slats; on the other hand, there are a lot of long penetrating holes 233 to be arranged in equal spacing in the middle section of the regulating shaft 23 allowing the inserting of the post 254 of the adapter 252. The rotation of the regulating wheel 24 causes the shifting leftward and rightward of the regulating shaft 23 and drives further the slats 25 to turn through the long penetrating holes 233. Pins 254 link slide shaft 23 to the adapter 252 which holds slat 25. Movement of shaft 23 force slats 25 to rotate about the center of shaft lever 253.

EMBODIMENT 4

Figure 6:
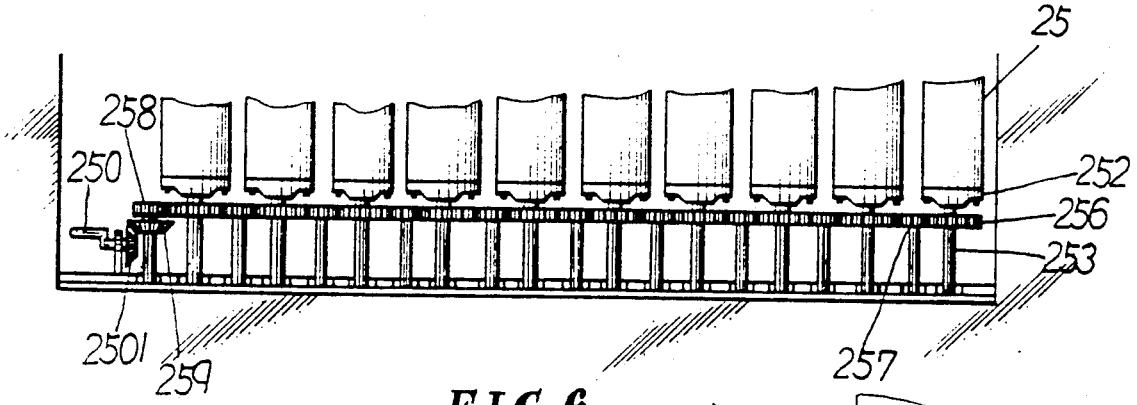
FIG. 6 is the lateral front view of embodiment 4 of the present invention.

As shown in FIG. 6, the positioning trough 212 of the fixing rail 21 allowing the inserting and positioning of the shaft lever 253 of the adapter 252, and the shaft lever 253 combines with a gear 256 to mesh with an idle gear 257 to be installed between the neighbouring gears 256, and there are a driving gear 258 and a bevel gear 259 to be combined on the lateral side of the final gear 256, the bevel gear 259 is meshed with the bevel gear 2501 to be combined with the rocker 250 for the purpose of the rotation of the driving gear 258, idle gear 257 and the gear 256 to regulate the slats by means of the rocking and rotating of the rocker 250 to change direction via the bevel gear 259, 2501.

EMBODIMENT 5

Figure 7:
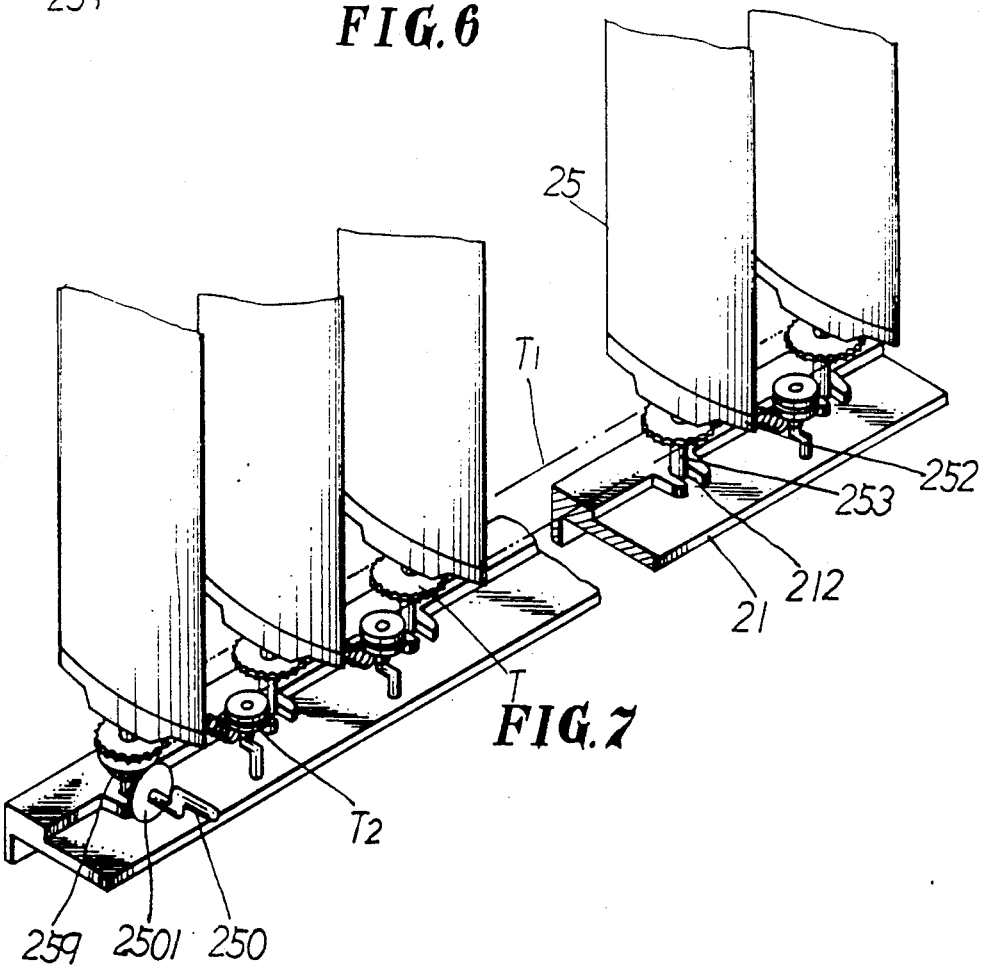
FIG. 7 is the solid view of the embodiment 5 of the present invention.

As shown in FIG. 7, the shaft lever 253 of the adapter 252 is inserted and positioned in the positioning trough 212 of the fixing rail 21, there is a chain wheel T to be combined with the shaft lever 253 and the chain wheel is combined with chain T1. A bevel gear 259 is combined at the bottom of the chain wheel T to be installed on the final slat 25, the bevel gear 259 meshes with the bevel gear 2501 which is combined with the rocker 250. A regulating guide pulley T2 is installed on the lateral side of the chain T1 to provide it with elasticity to press against chain T1 in order that the rocking and rotation of the rocker 250 would change direction by the two bevel gears 259, 2501 to bring the chain wheel T to turn via the driving chain T1 to attain the purpose of the regulating of the slats.

EMBODIMENT 6

Figure 8:
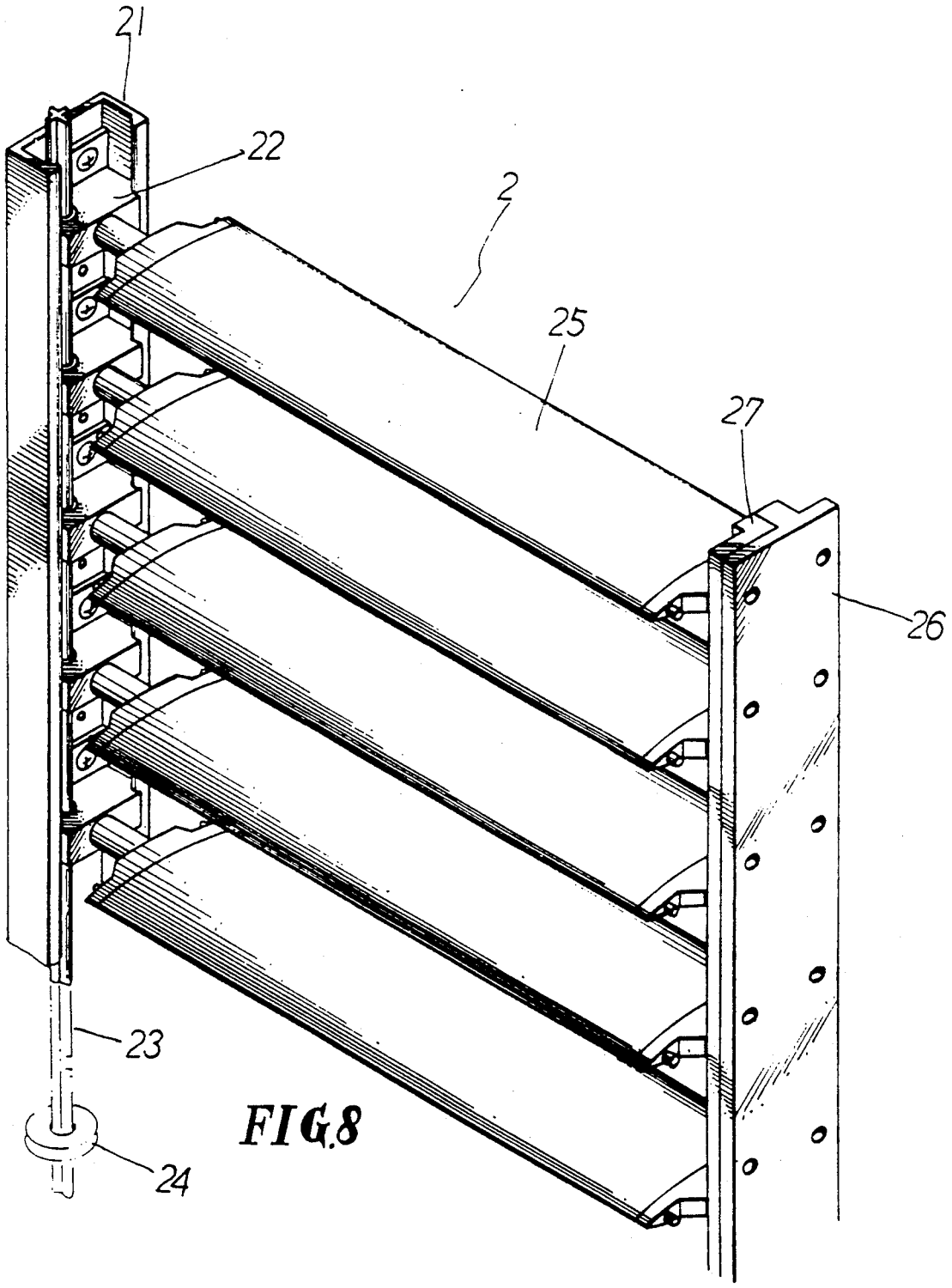
FIG. 8 is the solid view of embodiment 6 of the present invention.

As shown in FIG. 8, it is the horizontal construction of embodiment 1, to change the venetian blind from verticle type into horizontal type to provide the advantage of being able to be installed both horizontally and vertically. This is a special feature of the present invention which is not available in conventional venetian blinds.

What is claimed is:

1. A plurality of equally spaced supporting seats, each seat having a seat body, a shaft lever receiver pivoted with a worm wheel, a gear at the lower end to mesh with a worm gear, the shaft lever receiver having an axial hole, flanges on the two sides of the seat having pairs of penetrating holes corresponding with penetrating holes of an above fixing rail, screws for fastening the seat body on the fixing rail, wherein the rotation of the worm wheel drives the shaft lever receiver;

a regulating shaft connected to the worm gears in series to drive the worm wheel and shaft lever receiver to move synchronously;

a regulating wheel set on one end of the regulating shaft for rotation of the regulating shaft;

slats in same number of the supporting seats, having an identical adapter on either end a shaft lever in the center of the adapter to facilitate the slats to be positioned by the inserting of the shaft lever of the adapter at their respective shaft lever receivers;

a first fixing plate in strip shape with an axial flange which has positioning troughs in equal spacing on the lateral side corresponding with axle holes of the shaft lever receivers allowing the inserting and positioning of the shaft lever on the top end of the slats and having a plurality of generating holes on outside portions of the two sides of the flange;

a second fixing plate in right angular strip shape with a plurality of positioning troughs on a lateral side corresponding with the first fixing plate troughs to form full circular holes along with a plurality of penetrating holes corresponding with the first fixing plate penetrating holes for locking the two fixing plates together;

wherein a venetian blind constituted by the above components if fixed on the lower side of the window frame by means of a fixing rail which fixes the supporting seats in equal spacing, wherein the supporting seats are connected in series by a regulating shaft on which the worm gears are pivoted, wherein the regulating shafts combine with regulating wheels and the shaft lever receivers of the supporting seats combine with slats to insert the other end of the slats into the positioning trough between two fixing plates wherein the assembly is easy and the angle of the slats is adjusted by means of the driving of the regulating wheel.

* * * * *